US012042837B2

(12) United States Patent
Kawai et al.

(10) Patent No.: US 12,042,837 B2
(45) Date of Patent: Jul. 23, 2024

(54) DIE BLOCK DEVICE

(71) Applicant: UBE MACHINERY CORPORATION, LTD., Yamaguchi (JP)

(72) Inventors: Yuuto Kawai, Yamaguchi (JP); Norihiro Nishioka, Yamaguchi (JP)

(73) Assignee: UBE MACHINERY CORPORATION, LTD., Yamaguchi (JP)

( * ) Notice: Subject to any disclaimer, the term of this patent is extended or adjusted under 35 U.S.C. 154(b) by 0 days.

(21) Appl. No.: 17/932,482

(22) Filed: Sep. 15, 2022

(65) Prior Publication Data

US 2023/0136509 A1 May 4, 2023

(30) Foreign Application Priority Data

Nov. 1, 2021 (JP) ..... 2021-178531
Jul. 19, 2022 (JP) ..... 2022-114632

(51) Int. Cl.
*B21C 23/08* (2006.01)
*B21C 29/00* (2006.01)

(52) U.S. Cl.
CPC ..... *B21C 23/08* (2013.01); *B21C 29/003* (2013.01)

(58) Field of Classification Search
CPC ..... B21C 29/00; B21C 29/003; B21C 29/006; B21C 29/02; B21C 29/04; B21C 23/08; B21C 23/085
USPC ..... 72/253.1
See application file for complete search history.

(56) References Cited

U.S. PATENT DOCUMENTS 3,360,975 A * 1/1968 Edgecombe ..... B21C 29/02 72/272
6,898,954 B2 * 5/2005 Twigg ..... B21C 23/01 72/271

FOREIGN PATENT DOCUMENTS

JP H1085830 * 4/1998
JP H1085830 A 4/1998

* cited by examiner

*Primary Examiner* — Debra M Sullivan
(74) *Attorney, Agent, or Firm* — Pearne & Gordon LLP

(57) ABSTRACT

A die block device in an extruder including a cooling mechanism of a simple structure reciprocable between an operation position and a changing position. A die block portion configured to reciprocate between an operation position for extrusion and a changing position for die changing; and a gas supply portion configured to supply a cooling gas toward the die block portion. The die block portion includes a block body having a support surface that supports the die, and a gas channel having a supply port for the cooling gas and an exhaust port that extends from the supply port through the block body and opens into the support surface.

10 Claims, 9 Drawing Sheets

DIE BLOCK DEVICE

CROSS-REFERENCE TO RELATED APPLICATIONS

This application claims priority from Japanese Patent Application No. 2021-178531 filed on Nov. 1, 2021 and Japanese Patent Application No. 2021-114632 filed on Jul. 19, 2022. The content of this application is incorporated herein by reference in their entirety.

BACKGROUND OF THE INVENTION

Field of the Invention

The present invention relates to a die block device used in an extrusion press machine.

Description of the Related Art

An extrusion press machine is a device for manufacturing aluminum products by pressing an easily workable metal material such as aluminum or its alloys (hereinafter referred to as aluminum material) through a die and continuously extruding an aluminum product having a predetermined cross-sectional shape through the die (extrusion). The die has an opening with a cross-sectional shape similar to that of the aluminum product. An extruded long aluminum product is cut into individual aluminum products having a predetermined length.

With reference to FIG. 1, a conventional extrusion press machine and its extrusion process will be described. FIG. 1 is a schematic cross-sectional side view of an outline of a configuration of an extrusion press machine 100 without a detailed configuration shown. An aluminum material to be extruded is formed as a cylindrical billet B having a predetermined diameter appropriate for an extruded product W to be manufactured, and inserted into a billet accommodating portion 1A as a gap in a container 1.

A main cylinder 4 that creates extrusion pressure constitutes a hydraulic cylinder having only an oil chamber for moving a cylinder rod forward, and a main ram 4A corresponds to the cylinder rod. An extrusion stem 3 is mounted to the main ram 4A. Hydraulic oil supplied from a main pump unit 5 through a hydraulic circuit to the oil chamber in the main cylinder 4 moves a position of the main ram 4A (ram position) toward the die 2 (forward/to the right side in FIG. 1), and then the extrusion stem 3 also moves (forward) to press the billet B through the die 2. By this pressing, the billet B is pressurized in the container 1, and continuously extruded through an opening of a die 2 having a cross-sectional shape similar to that of an extruded product W. Reference numeral 6 denotes an end platen, and reference numeral 6*a* denotes a pressure ring embedded in the end platen 6 and subjected to a pressing force applied to the die 2. In FIG. 1, the main pump unit 5 is shown as a hydraulic pump for simplicity of drawing.

Although not shown in FIG. 1, the die 2 includes a plurality of members, is accommodated in a die block (also referred to as a die cassette), and is arranged movably by a die slide mechanism (not shown) between an extrusion operation position during the extrusion process and a die changing position spaced apart from the extrusion press machine. The die 2 includes a small diameter part 2A and a large diameter part 2B, and the small diameter part 2A is provided for extrusion.

As disclosed in JP 10-085830 A, a die block may include a plurality of heating means arranged in parallel with an extrusion direction. This is for preventing defective dimension accuracy or shape of an extruded product by heating and keeping a peripheral surface of the die 2 at a desired temperature for a billet preheated to about 400° C. for extrusion.

However, continuing the extrusion process causes a rise in temperature of the die due to friction between an inner peripheral surface of the part of the die that has an opening with a cross-sectional shape similar to that of the extruded product and is provided for extrusion, and the extruded product being extruded. The rise in temperature of the die may reduce quality of the extruded product. On the other hand, if a cooling mechanism is to be arranged in the die block to suppress the rise in temperature of the die, the die block is moved by the die slide mechanism between the extrusion operation position (operation position) and the die changing position (changing position), and thus the cooling mechanism also needs to be moved, which complicates piping of the cooling mechanism.

The present invention is achieved in view of the above described problems, and has an object to provide a die block device in an extruder including a cooling mechanism of a simple structure reciprocable between the extrusion operation position and the die changing position.

SUMMARY OF THE INVENTION

The die block device according to the present invention includes: a die block portion configured to reciprocate between an operation position for extrusion and a changing position for die changing; and a gas supply portion configured to supply a cooling gas toward the die block portion.

The die block portion includes a block body having a support surface that supports the die, and a gas channel having a supply port for the cooling gas and an exhaust port that extends from the supply port through the block body and opens into the support surface.

The gas supply portion includes a supply passage provided to communicate with the gas channel through the supply port when the die block portion is in the operation position.

The die block portion in the present invention may include a plurality of gas channels, and the gas supply portion may include the supply passage communicating with each of the plurality of gas channels.

The support surface in the present invention may have an arcuate surface when viewed from front, and may have the exhaust port of the gas channel, the exhaust port opening within a range of ±30° in a height direction with reference to a center of curvature of the arcuate surface.

The block body in the present invention may hold the die including a small diameter part provided for extrusion and a large diameter part continuous with the small diameter part, and the block body may include a small diameter support part that supports the small diameter part of the die, and a large diameter support part that supports the large diameter part of the die.

The gas channel is provided in one or both of the small diameter support part and the large diameter support part.

The block body in the present invention preferably has a temperature sensor incorporated therein, and when a detected temperature of the block body by the temperature sensor exceeds a previously set temperature, the cooling gas is supplied to the supply passage.

The block body in the present invention preferably has a heater incorporated therein, and when the detected temperature exceeds the previously set temperature, a heating set temperature by the heater is reduced, and the detected temperature is further monitored for a previously set time. When the detected temperature exceeds the set temperature, the cooling gas is supplied to the supply passage until the detected temperature falls below the set temperature.

In the die block device according to the present invention, the gas channel is provided in the die block portion configured to reciprocate between the operation position and the changing position, and when the die block portion is in the operation position, the supply passage in the gas supply portion communicates with the gas channel. Then, when the die block portion is moved from the operation position to the changing position, the communication between the gas channel and the supply passage is released. As such, the gas supply portion is positionally fixed independently of the position of the die block portion. Thus, even if the gas supply portion includes other components in the supply passage such as an open/close switching valve or a stop valve, such components need not be moved according to the movement of the die block portion. Thus, even if the die block device according to the present invention includes a cooling mechanism configured to cool the die, the cooling mechanism is not complicated.

DETAILED DESCRIPTION OF THE PREFERRED EMBODIMENTS

Now, embodiments of the present invention will be described with reference to the accompanying drawings. The embodiments described below are not intended to limit the invention according to claims, and not all of combinations of features described in the embodiments are essential to the solution of the invention.

First embodiment: FIGS. 2, 3, 4, 5, 6, and 7

Figure 1:
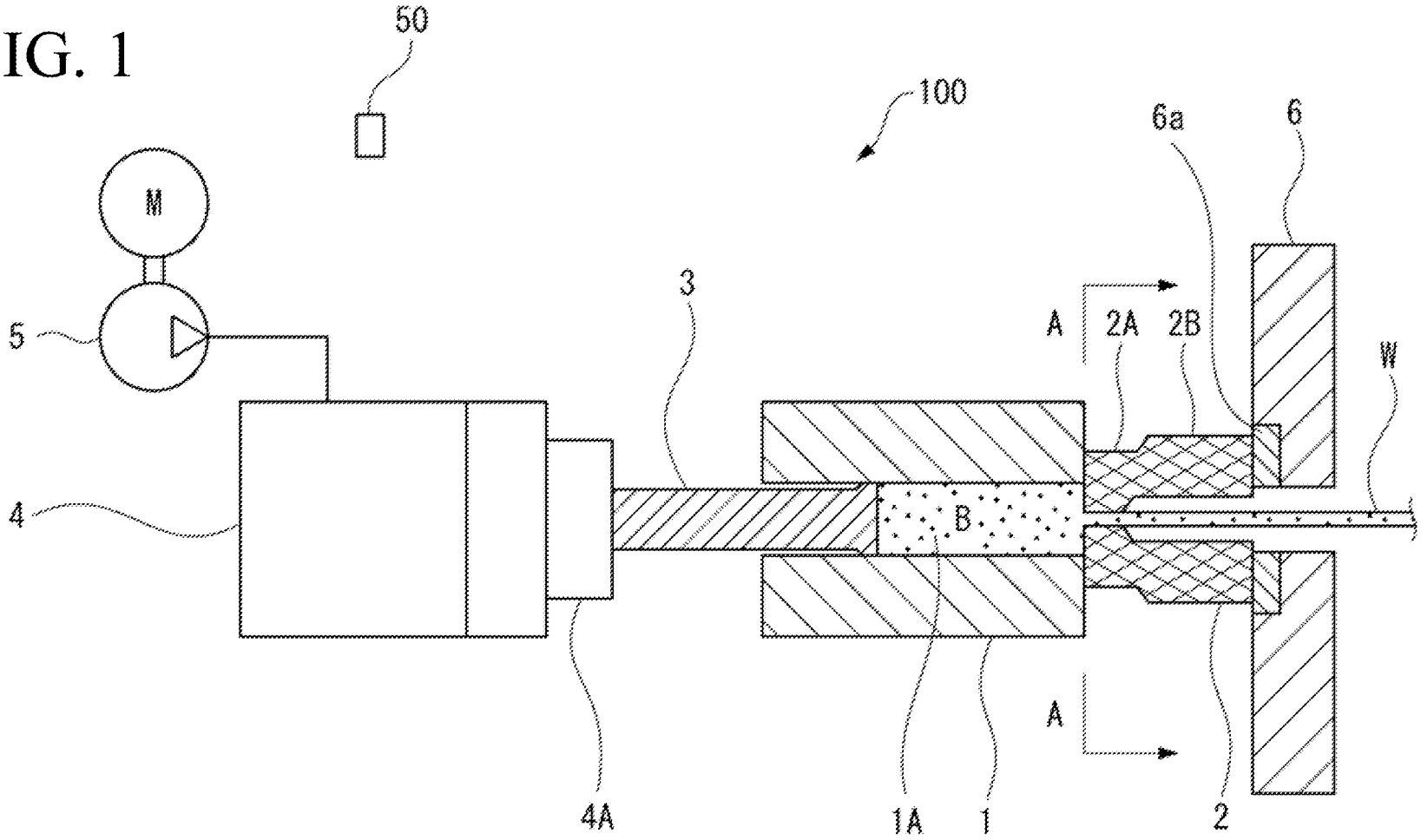
FIG. 1 is a schematic cross-sectional side view showing an outline of a configuration of an extrusion press machine.
Figure 2:
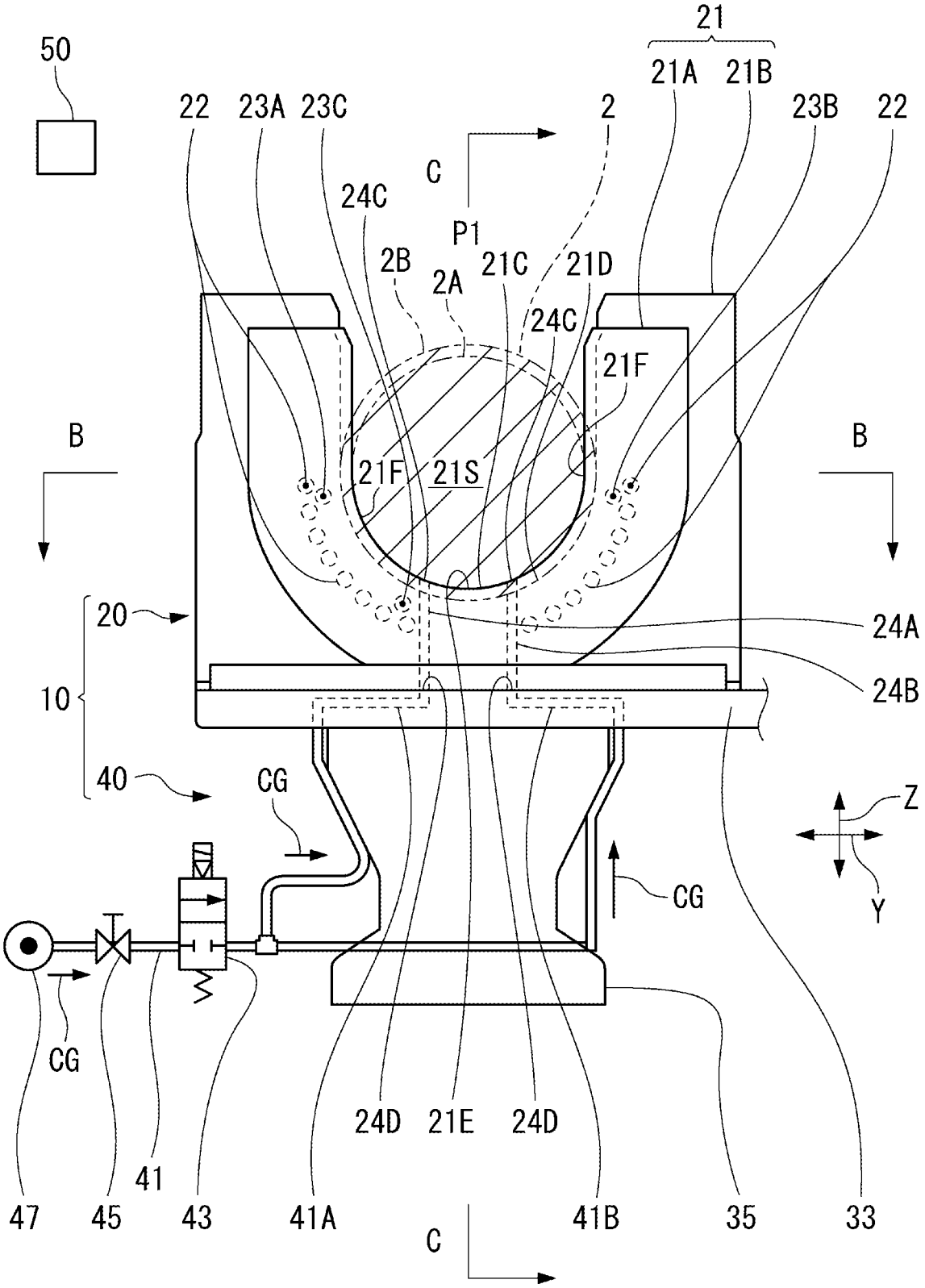
FIG. 2 is a view taken along the arrowed line A-A in FIG. 1 showing a die block device according to a first embodiment.
Figure 3:
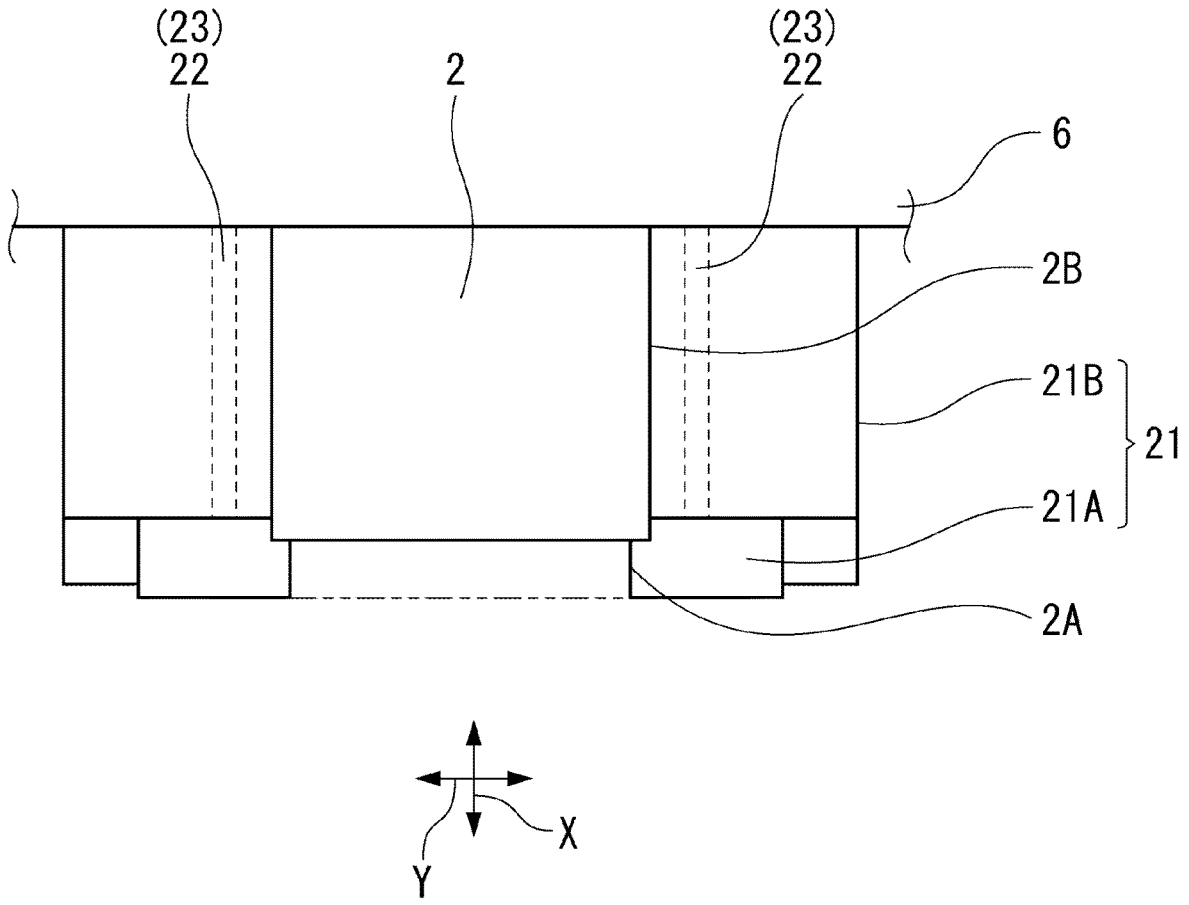
FIG. 3 is a view taken along the arrowed line B-B in FIG. 2 showing the die block device according to the first embodiment.
Figure 4:
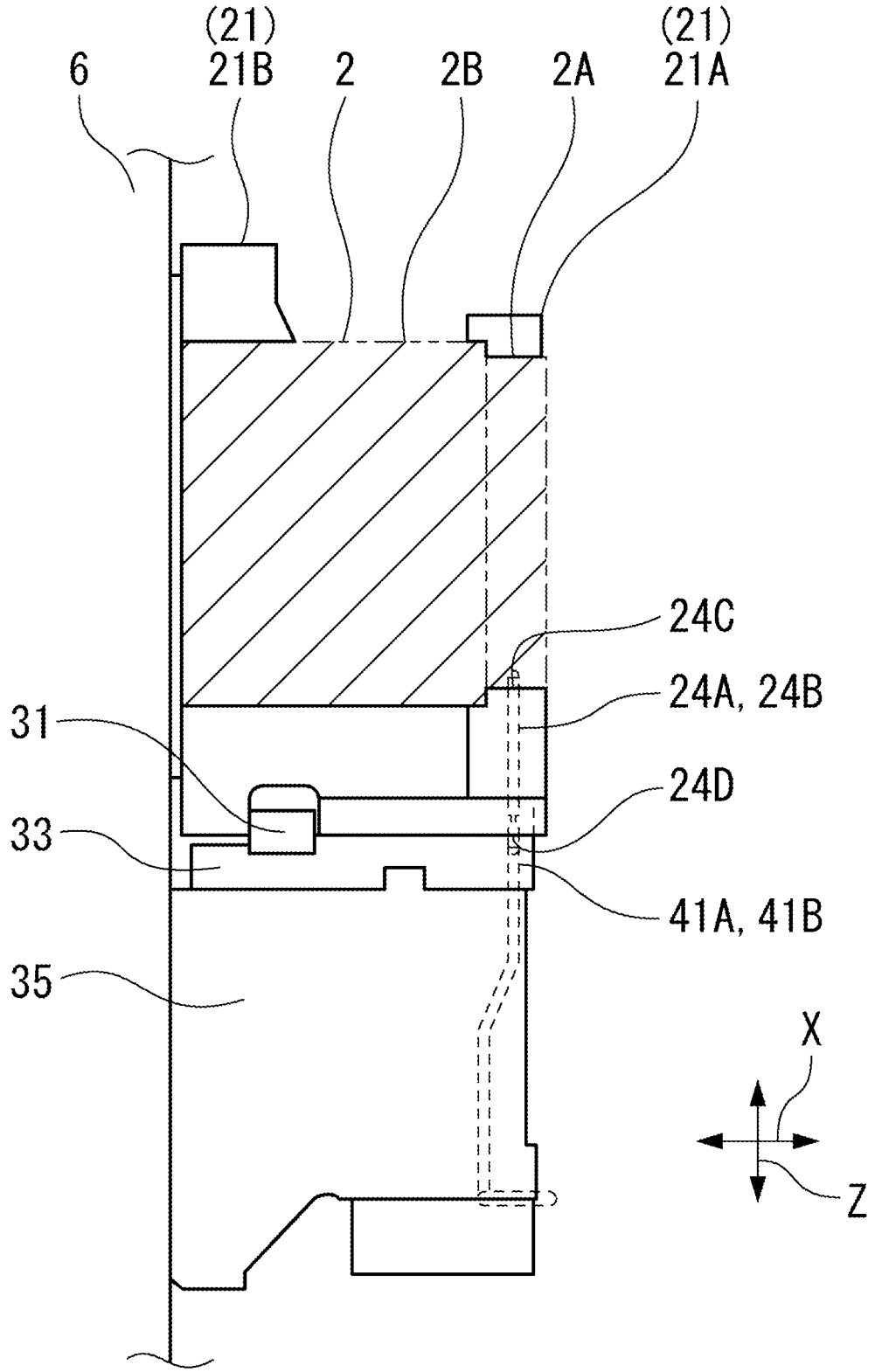
FIG. 4 is a view taken along the arrowed line C-C in FIG. 2 showing the die block device according to the first embodiment.

With reference to FIGS. 2 to 7, a die block device 10 in an extrusion press machine 100 according to a first embodiment will be described. FIG. 2 is a view taken along the arrowed line A-A in FIG. 1 showing the die block device 10 according to the first embodiment. Similarly, FIG. 3 is a view taken along the arrowed line B-B in FIG. 2 showing the die block device 10 according to the first embodiment, and FIG. 4 is a view taken along the arrowed line C-C in FIG. 2 showing the die block device 10 according to the first embodiment.

As shown in FIGS. 2 to 4, the die block device 10 includes a die block portion 20 including a die block body 21, and a gas supply portion 40 configured to supply a cooling gas CG to the die block body 21. The die block portion 20 is reciprocable between an operation position P1 in FIG. 2 and a changing position P2 in FIG. 5 in a width direction Y. On the other hand, the gas supply portion 40 is positionally fixed. The gas supply portion 40 includes a plurality of components as described later, but has a simple structure because of its fixed position. Now, configurations of the die block portion 20 and the gas supply portion 40 will be sequentially described, and then operation of the die block device 10 will be described.

Die block portion 20: FIGS. 2 to 4

As shown in FIGS. 2 to 4, the die block portion 20 includes the die block body 21 that accommodates and supports a die 2, and a heater 22 and a temperature sensor 23 which are incorporated in the die block body 21. The die block portion 20 includes gas channels 24A, 24B configured to supply a cooling gas CG toward the die 2 held by the die block body 21.

Die Block Body 21

The die block body 21 includes a small diameter support part 21A that supports a small diameter part 2A of the die 2, and a large diameter support part 21B that supports a large diameter part 2B of the die 2. As shown in FIG. 1, the small diameter support part 21A is arranged closer to a container 1, and the large diameter support part 21B is arranged closer to an end platen 6. Thus, the small diameter support part 21A holds the small diameter part 2A on the side of the container 1 (near side in FIG. 2), and the large diameter support part 21B supports the large diameter part 2B on the side of the end platen 6. As shown in FIG. 1, a billet B is extruded by the small diameter part 2A of the die 2 into an extruded product W, and the extruded product W sequentially passes through the large diameter part 2B and the end platen 6.

The small diameter support part 21A and the large diameter support part 21B of the die block body 21 include a small diameter support surface 21C and a large diameter support surface 21D that support the small diameter part 2A and the large diameter part 2B, respectively, of the die 2. The small diameter support surface 21C and the large diameter support surface 21D are arcuate surfaces when viewed from front. A region surrounded by the arcuate surfaces is an accommodation space 21S for the die 2. The small diameter support surface 21C has a smaller radius of curvature than the large diameter support surface 21D. When the die block body 21 holds the die 2, the small diameter part 2A comes into contact with the small diameter support surface 21C, and the large diameter part 2B comes into contact with the large diameter support surface 21D, with a clearance through which the cooling gas CG flows between the die block body 21 and the die 2.

The small diameter support surface 21C and the large diameter support surface 21D each include a lower support surface 21E and a pair of side support surfaces 21F, 21F continuous with the lower support surface 21E. The side support surfaces 21F, 21F are provided opposite each other on opposite sides of the accommodation space 21S in the width direction Y. As described below in detail, the gas channels 24A, 24B are provided correspondingly to the lower support surface 21E.

Figure 5:
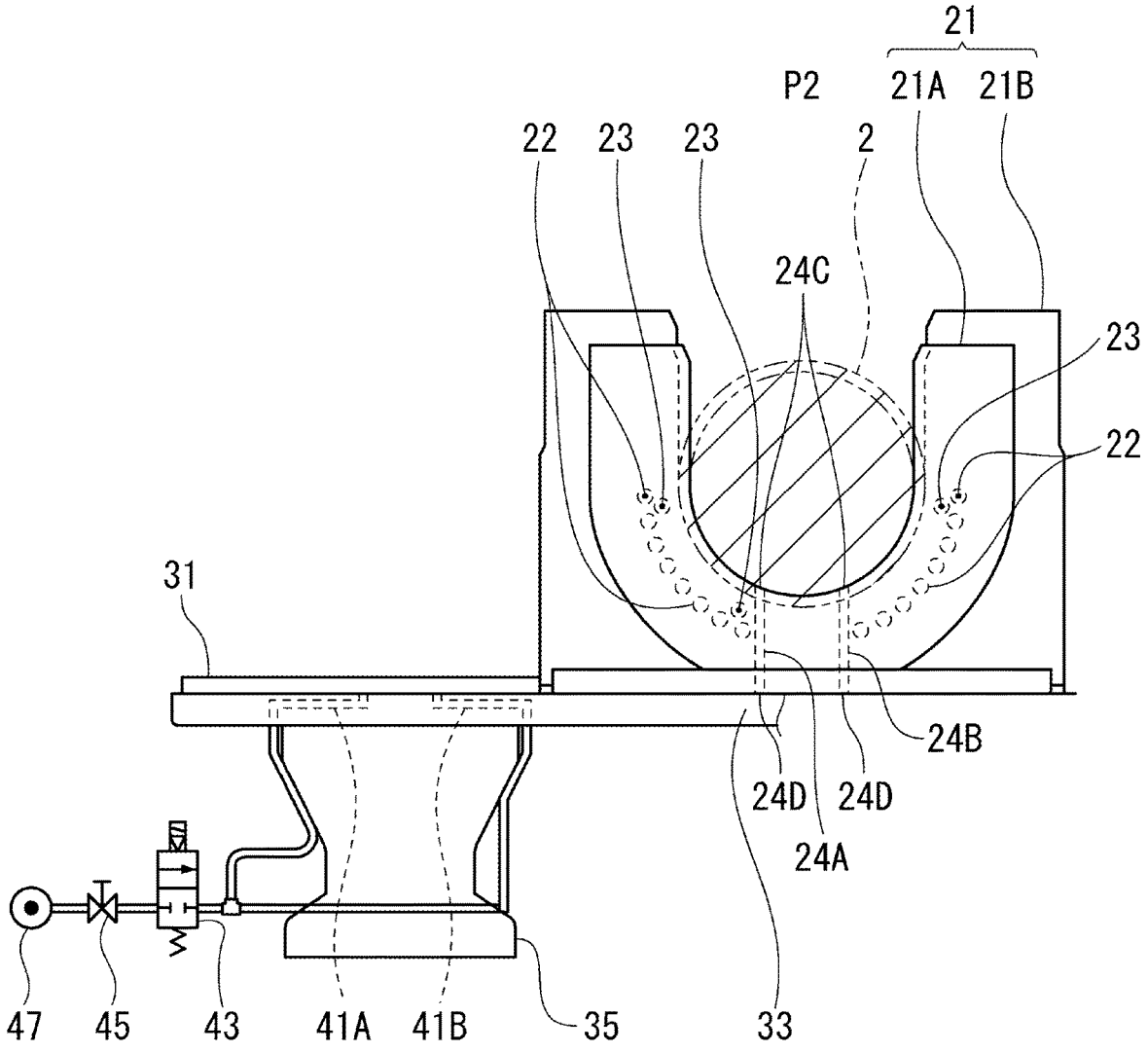
FIG. 5 is a view taken along the arrowed line A-A in FIG. 1 showing the die block device according to the first embodiment and showing a die block having moved to a die changing position.

The die block portion 20 can reciprocate with a slide device (not shown) between an operation position P1 (FIG. 2) and a changing position P2 (FIG. 5) in the width direction Y perpendicular to an extrusion direction X. Thus, the die block portion 20 is arranged on a lower gib 33 via a guide member 31 (FIG. 4) extending in the width direction Y. The lower gib 33 is supported by a lower gib support member 35 arranged to protrude from the end platen 6. FIG. 2 shows the die block portion 20 in the operation position P1, and FIG. 5 shows the die block portion 20 in the changing position P2. Another guide member configured to guide linear reciprocation between the operation position P1 and the changing position P2 in the width direction Y perpendicular to the extrusion direction X of the die block body 21 is also provided on an upper side of the die block portion 20, but is not shown for clarity of the drawing.

Heater 22 and Temperature Sensor 23

As shown in FIGS. 2 and 3, the heater 22 and the temperature sensor 23 are incorporated in the die block body 21 of the die block portion 20. The heater 22 and the temperature sensor 23 are inserted into insertion holes (far side in FIG. 2/upper side in FIG. 3) formed from a rear end to a front end of the large diameter support part 21B of the die block body 21 and thus incorporated in the die block body 21.

The heater 22 may be various devices capable of heating an object, such as a rod-like ceramic heater or a wire heater. The heater 22 is provided such that its length direction is along the extrusion direction X. In this embodiment, a plurality of heaters 22 are arranged to surround the small diameter support surface 21C and the large diameter support surface 21D each having the arcuate shape of the die block body 21. In this embodiment, no heater 22 is provided between the gas channels 24A, 24B. However, a heater 22 may be provided between the gas channels 24A, 24B depending on arrangement of the gas channels.

The temperature sensor 23 may be various devices capable of measuring a temperature, such as a thermocouple, a thermistor, a platinum resistance temperature detector, or a bimetallic thermometer. A plurality of temperature sensors 23 are also provided as an example, and temperature sensors 23A, 23B are provided on opposite sides in the width direction Y near upper ends of the small diameter support surface 21C and the large diameter support surface 21D, and a temperature sensor 23C is provided near lower ends of the small diameter support surface 21C and the large diameter support surface 21D.

Gas Channels 24A, 24B: FIGS. 2 and 4

As shown in FIGS. 2 and 4, the die block portion 20 includes the gas channels 24A, 24B configured to discharge the cooling gas CG supplied from the gas supply portion 40 toward the die 2 accommodated in the die block body 21. The gas channels 24A, 24B are gaps formed to extend between an outer peripheral surface of the small diameter support part 21A and the small diameter support surface 21C along a height direction Z. The gas channels 24A, 24B include supply ports 24D, 24D through which the cooling gas CG is supplied from the gas supply portion 40, and exhaust ports 24C, 24C through which the supplied cooling gas CG is discharged toward the small diameter part 2A of the die 2.

In this embodiment, the pair of gas channels 24A, 24B are provided symmetrically with respect to a line segment CL (see FIG. 6) extending in the height direction Z through a center of curvature C of the arcuate small diameter support surface 21C. The cooling gas CG discharged through the gas channels 24A, 24B flows through the clearance between the small diameter support part 21A of the die block body 21 and the small diameter part 2A of the die 2, mainly from the lower support surface 21E toward the side support surfaces 21F, 21F, thereby cooling the small diameter support part 21A and the die 2. The main flow of the cooling gas CG corresponds to a region provided with the heaters 22. Also between the gas channels 24A, 24B, the cooling gas CG flows between the small diameter support part 21A and the small diameter part 2A.

As the die block body 21 reciprocates in the width direction Y, the positions of the gas channels 24 move. The gas channels 24 as the gaps formed by perforating the small diameter support part 21A has been described herein, but the gas channels 24 may be formed of pipes.

Figure 6:
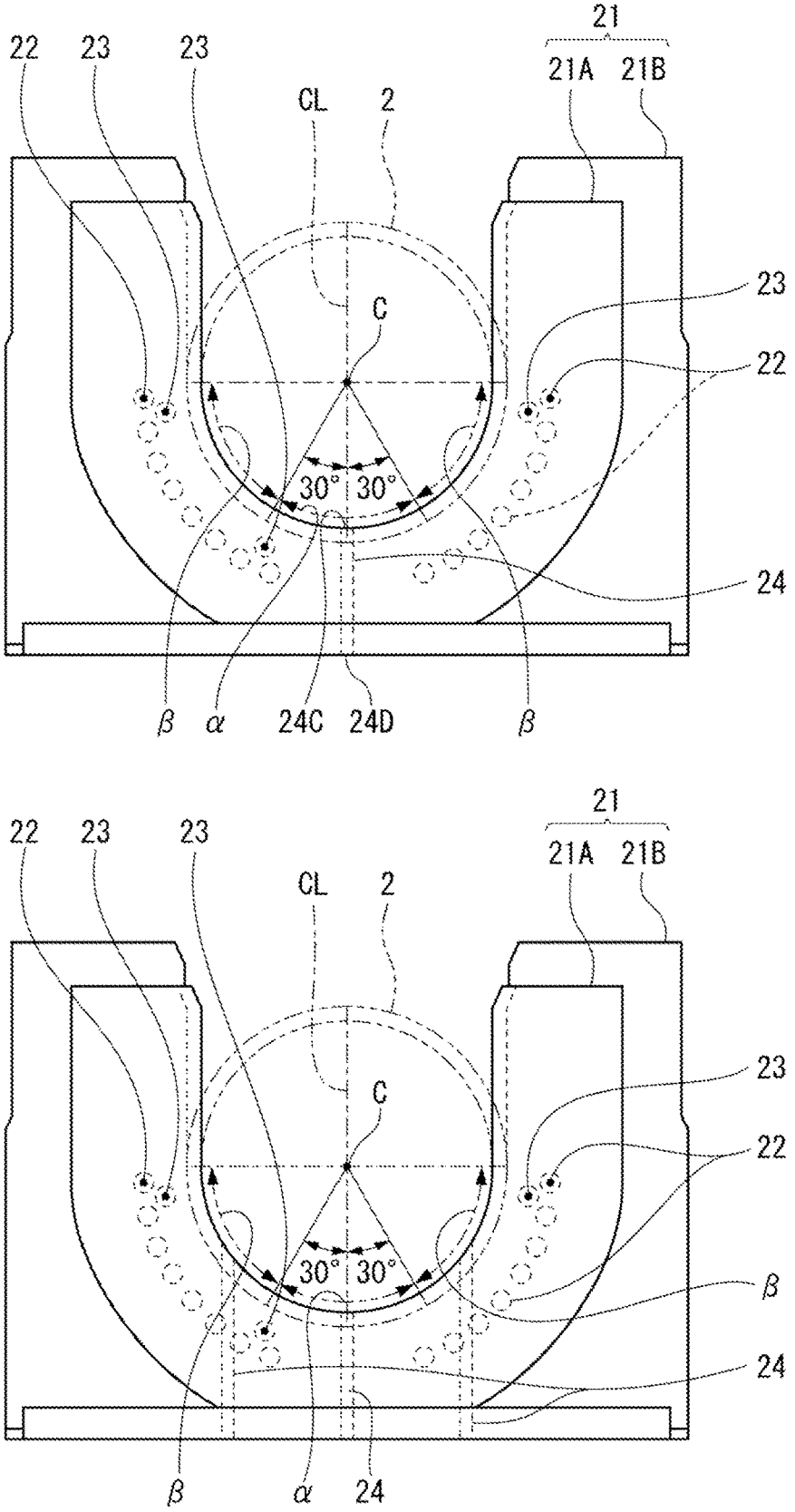
FIG. 6 shows a variant of the die block device according to the first embodiment.

In FIG. 6, with reference to the center of curvature C on the line segment CL, a range of a center angle of ±30° is referred to as a lower area α, and regions above the lower area a are referred to as side areas β, β. The temperature sensors 23A, 23B are provided in the side areas β, β, and the temperature sensor 23C is provided in the lower area α. The gas channels 24A, 24B are also provided in the lower area α.

Gas Supply Portion 40: FIGS. 2 and 5

Next, the gas supply portion 40 configured to supply the cooling gas CG toward the die block portion 20 will be described.

The gas supply portion 40 includes a supply passage 41 (41A, 41B) configured to supply the cooling gas CG toward the gas channels 24, an open/close switching valve 43 and a stop valve 45 arranged in the supply passage 41, and a gas supply source 47 that stores the cooling gas CG to be supplied to the supply passage 41. The supply passage 41 is connected to the gas supply source 47 at an upstream end of the flow of the cooling gas CG. The supply passage 41 branches to the supply passage 41A and the supply passage 41B downstream of the open/close switching valve 43.

While the die block portion 20 is moving between the operation position P1 and the changing position P2, the gas supply portion 40 remains in a fixed position. The supply passage 41A corresponds to the gas channel 24A, and the supply passage 41B corresponds to the gas channel 24B. As shown in FIG. 2, in the operation position P1, the supply passage 41A communicates with the gas channel 24A, and the supply passage 41B communicates with the gas channel 24B. As shown in FIG. 5, when the die block portion 20 is moved by a die slide mechanism (not shown) from the operation position P1 to the changing position P2, the communication between the gas channels 24A, 24B and the supply passages 41A, 41B is released. Thus, the supply passage 41, the open/close switching valve 43, and the stop valve 45 that constitute the gas supply portion 40 need only be arranged on the lower gib support member 35 or the like positionally fixed near the die block portion 20 in the operation position P1, and such components need not be moved according to the movement of the die block portion 20. With such a configuration, even if the cooling mechanism configured to cool the die 2 accommodated in the die block portion 20 is arranged in the die block portion 20, piping of the cooling mechanism is not complicated.

Although not shown, in communicating parts between the gas channels 24A, 24B and the supply passage 41, packing or the like is preferably provided in an opening of each communicating part on the side of the die block portion 20 or the side of the lower gib 33, thereby suppressing leakage of the cooling gas CG through the communicating parts between the gas channels 24A, 24B and the supply passage 41.

Variant of Gas Channel 24: FIG. 6

The example of the pair of gas channels 24A, 24B being provided has been described. However, as shown in the upper section in FIG. 6, one gas channel 24 may be provided along a centerline CL. Alternatively, as shown in the lower section in FIG. 6, two gas channels 24, 24 may be provided symmetrically with respect to one gas channel 24. The two gas channels 24, 24 in the latter case open into the side support surfaces 21F, 21F.

Controller 50: FIG. 2

The die block device 10 includes a controller 50 configured to control operation of the die block device 10.

In an extrusion process, the controller 50 performs heating control of the die 2 with the heater 22 and cooling control of the die 2 with the cooling gas CG. The controller 50 can also control the reciprocation of the die block portion 20.

The controller 50 stores previously set heating and heat retaining patterns of the die 2 for the heating control of the die 2. The controller 50 also stores information on a set temperature Ts relating to an upper limit of detected temperatures and a previously set time Ss used in a second control mode. The controller 50 can store other information required for operation of the die block device 10.

The controller 50 continuously obtains information on detected temperatures Td (TdA, TdB, TdC) by the temperature sensors 23A, 23B, 23C and compares the detected temperatures Td with the set temperature Ts. Based on a result of the comparison of the detected temperatures Td with the set temperature Ts, the controller 50 operates the gas supply portion 40 to supply the cooling gas CG from the supply passage 41 to the gas channel 24.

The controller 50 also compares an elapsed time Sd with the set time Ss for suppressing heating of the heater 22. Based on a result of the comparison of the elapsed time Sd with the set time Ss, the controller 50 can operate the gas supply portion 40 to supply the cooling gas CG from the supply passage 41 to the gas channel 24.

The controller can include a display device such as an LCD (liquid crystal display) for displaying the above results of comparisons.

Figure 7:
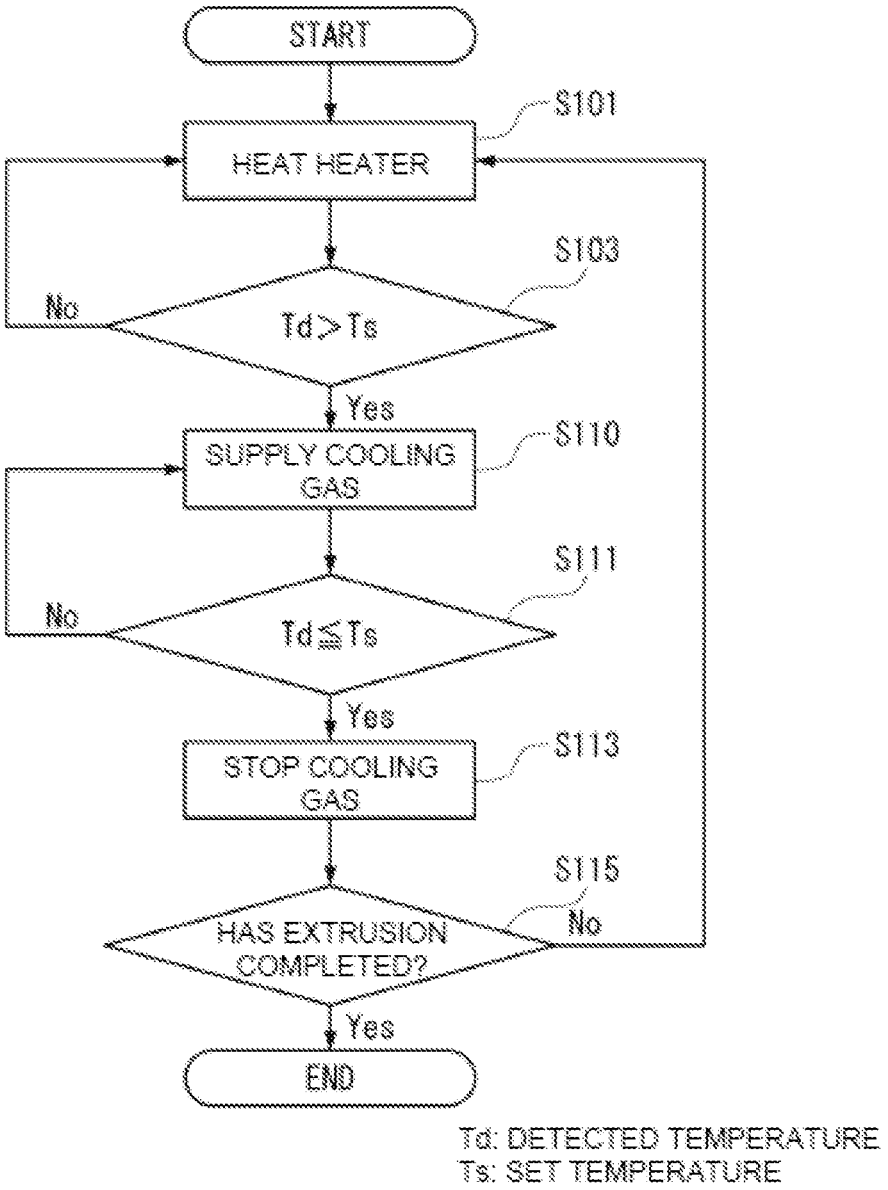
FIG. 7 is a flow diagram of a first control mode of a cooling gas CG in the die block device according to the first embodiment.
Figure 8:
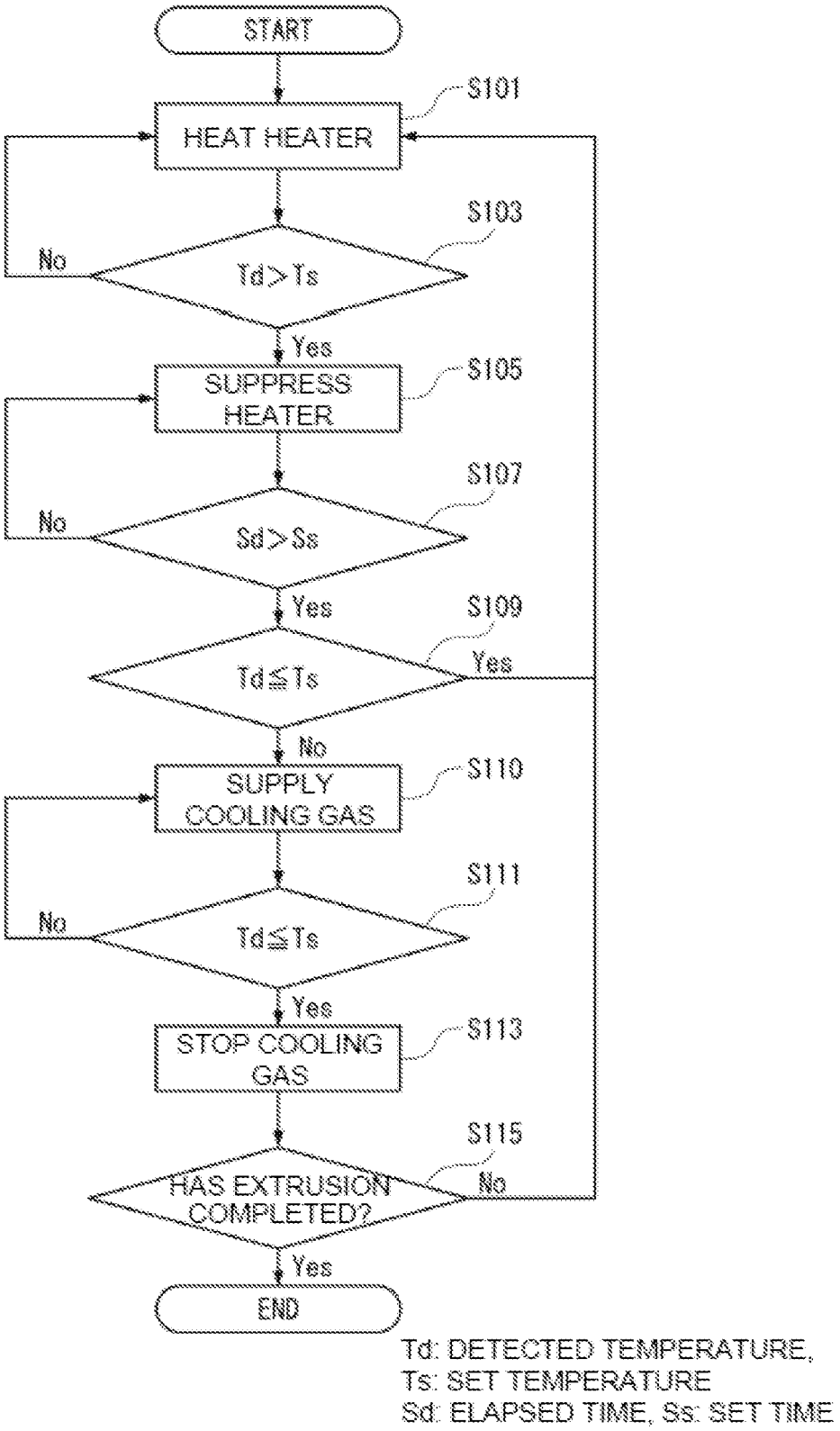
FIG. 8 is a flow diagram of a second control mode of the cooling gas CG in the die block device according to the first embodiment.

Cooling Control: FIGS. 7 and 8

Next, with reference to FIG. 7 (first control mode) and FIG. 8 (second control mode), the cooling control of the die 2 accommodated in the die block body 21 will be described. The cooling control is performed based on instructions from the controller 50 described above. In the first control mode (FIG. 7), the cooling gas CG is immediately discharged toward the die 2 based on the result of comparison of the detected temperatures Td with the set temperature Ts. In the second control mode (FIG. 8), the heating temperature by the heater 22 is reduced before discharge of the cooling gas CG. Now, the first control mode and the second control mode will be sequentially described.

First Control Mode: FIG. 7

When the extrusion process starts, the controller 50 operates the heater 22 to control temperatures of the lower area α and the side areas β of the die block body 21 based on the previously set heating and heat retaining patterns of the die 2 with reference to the detected temperatures Td by the temperature sensors 23 (S101 in FIG. 7). In the first embodiment, the temperature sensors 23 (23A, 23B, 23C) are arranged in three places (FIG. 2) such that heating control is performed in each of three areas: the lower area and the opposite side areas of the block body 21. The temperatures detected by the temperature sensors 23A, 23B, 23C are denoted by TdA, TdB, TdC, respectively, but sometimes collectively referred to as the detected temperatures Td.

When the extrusion process continues, the billet B is pressed through the die 2, and an extruded product W is extruded through an opening having a cross-sectional shape similar to that of the extruded product W, and thus the die 2 is heated by friction with the extruded product W and rises in temperature. The temperature sensors 23A, 23B, 23C continuously detect the temperatures since the start of the extrusion process, and the detected temperatures TdA, TdB, TdC (Td) as detection results are transmitted to the controller 50. The controller 50 compares each of the obtained detected temperatures TdA, TdB, TdC with the previously stored set temperature Ts (S103).

When the controller 50 determines that any of the detected temperatures TdA, TdB, TdC (Td) exceeds the set temperature Ts (Yes in S103), the controller 50 operates the gas supply portion 40 and instructs the gas supply portion 40 to supply the cooling gas CG from the supply passages 41A, 41B to the gas channels 24A, 24B (S110).

Even after the instruction to supply the cooling gas CG, the controller 50 continuously obtains the detected temperatures TdA, TdB, TdC and compares the detected temperatures with the set temperature Ts. If any of the detected temperatures TdA, TdB, TdC exceeds the set temperature Ts, the controller 50 continues the instruction to supply the cooling gas CG (No in S111). If all of the detected temperatures TdA, TdB, TdC become equal to or lower than the set temperature Ts (Yes in S111), the controller 50 stops the instruction to supply the cooling gas CG (S113).

The controller 50 continues the above control until the end of the extrusion process.

Second Control Mode: FIG. 8

Next, with reference to FIG. 8, the second control mode will be described. The second control mode partially follows the first control mode, and thus differences from the first control mode will be mainly described below.

If the controller 50 determines that any of the detected temperatures TdA, TdB, TdC (Td) exceeds the set temperature Ts (Yes in S103), the controller 50 instructs to suppress heating by the heater 22 incorporated in the die block body 21 in an area where the temperature higher than the set temperature is detected (S105 in FIG. 8). For example, if the detected temperature TdA by the temperature sensor 23A exceeds the set temperature Ts, the controller 50 instructs to suppress heating by the heater 22 in the side area β.

Suppressing heating herein means both stopping heating by the heater 22 and reducing the heating temperature.

The controller 50 suppresses heating, and also monitors the detected temperature Td by the temperature sensor 23 in that area. Then, if the elapsed time Sd from the start of suppression of heating exceeds the previously set time Ss (Yes in S107), but the detected temperature Td by the temperature sensor 23 in that area does not fall below the set temperature Ts (No in S109), the controller 50 opens the open/close switching valve 43 in the supply passage 41 to eject the cooling gas CG toward the small diameter part 2A of the die 2 through the supply passage 41 and the gas channels 24A, 24B, thereby starting cooling of the die 2 (S110). The cooling is continued until all of the detected temperatures by the temperature sensors 23A to 23C fall below the set temperature (S111). Hereinafter, control is performed through the same steps as in the first control mode.

The two cooling control modes have been described above. However, the detected temperatures TdA, TdB, TdC (Td) by the temperature sensors 23 may be displayed on a display device of the controller 50, and an operator may check the display device. When any of the detected temperatures exceeds the set temperature, the operator may manually operate the gas supply portion 40 to supply the cooling gas CG from the supply passage 41 to the gas channel 24.

Effect of First Embodiment

As described above, the gas channels 24A, 24B arranged in the die block body 21 communicate with the supply passage 41 of the gas supply portion 40 when the die block body 21 is in the operation position. Thus, even if the cooling mechanism configured to cool the die 2 accommodated in the die block body 21 is arranged in the die block body 21, piping of the cooling mechanism is not complicated.

Also, both the heating and heat retaining control and the cooling control of the die 2 accommodated in the block body 21 can be performed. This can prevent defective dimension accuracy or shape of an extruded product by heating and keeping a peripheral surface of the die 2 at a desired temperature.

In the first embodiment, assuming that an area near the small diameter part 2A of the die 2 is heated by friction with the extruded product W and most rises in temperature, the area can be cooled by ejecting the cooling gas CG. According to the first embodiment, an increase in cooling efficiency of the die 2 can be expected. A flow control valve may be provided in the supply passage 41 such that a supply amount of the cooling gas CG to be ejected is adjustable.

Figure 9:
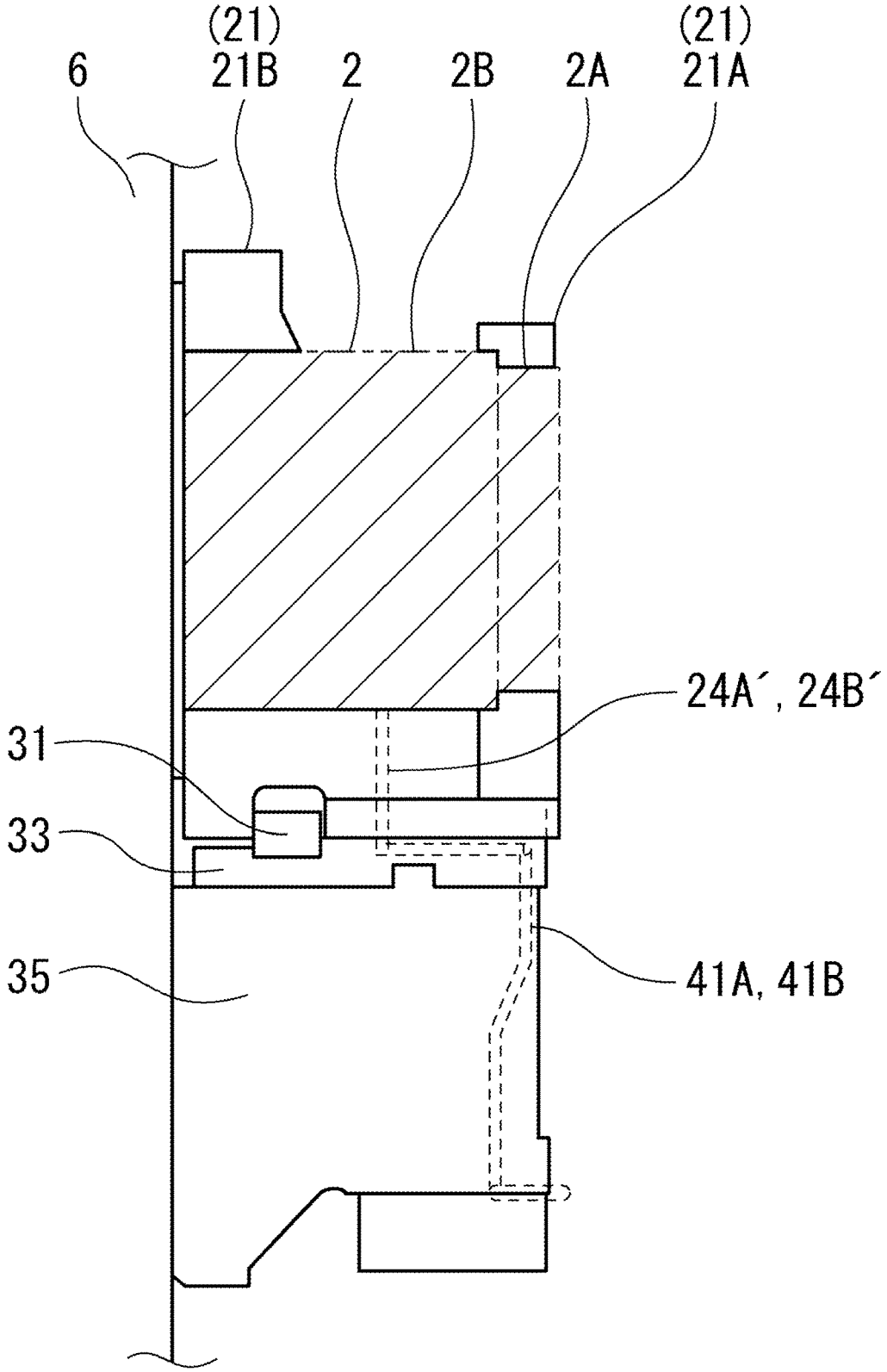
FIG. 9 is a view taken along the arrowed line C-C in FIG. 2 showing a die block device according to a second embodiment.

Second Embodiment: FIG. 9

In the first embodiment, in the extrusion process, the small diameter part 2A of the die 2 is heated by friction with the extruded product W and most rises in temperature. However, depending on extrusion conditions or extruded products, areas other than the small diameter part 2A of the die 2, for example, a predetermined area of the large diameter part 2B of the die 2 may most rise in temperature. A second embodiment accommodates such a case.

As shown in FIG. 9, in the second embodiment, gas channels 24A', 24B' of the die block body 21 are provided in the large diameter support part 21B that supports the large diameter part 2B of the die 2.

The first embodiment and the second embodiment have been described above. However, the present invention is not limited to the above embodiments, but may be embodied in various ways without departing from the contents of claims.

What is claimed is:

1. A die block device comprising:

a die block portion configured to reciprocate between an operation position for extrusion and a changing position for a die changing operation;

a gas supply portion configured to supply a cooling gas toward the die block portion; and a controller, wherein the die block portion includes a block body having a support surface that supports a die, a temperature sensor that detects a block body temperature, a heater incorporated in the block body, and a gas channel having a supply port for the cooling gas and an exhaust port that extends from the supply port through the block body and opens into the support surface, the gas supply portion includes a supply passage provided to communicate with the gas channel through the supply port when the die block portion is in the operation position, the die block device is configured such that communication between the supply passage of the gas supply portion and the gas channel of the die block portion is released when the die block portion moves from the operation position to the changing position, the controller is configured to determine if the block body temperature detected by the temperature sensor exceeds a previously set temperature, and when the detected block body temperature exceeds the previously set temperature, the controller is configured to:

reduce a heating temperature of the heater, further monitor the detected block body temperature for a previously set time, and supply the cooling gas to the supply passage until the detected block body temperature falls below the previously set temperature.

2. The die block device according to claim 1, wherein the die block portion includes a plurality of the gas channels, and the gas supply portion includes the supply passage communicating with each of the plurality of the gas channels.

3. The die block device according to claim 2, wherein the support surface has an arcuate surface when viewed from front, and has the exhaust port of the gas channel, wherein an opening of the exhaust port is located within a range of ±30° from a height direction with reference to a center of curvature of the arcuate surface.

4. The die block device according to claim 2, wherein the block body holds the die including a small diameter part provided for extrusion and a large diameter part continuous with the small diameter part, the block body includes a small diameter support part that supports the small diameter part of the die, and a large diameter support part that supports the large diameter part of the die, and the gas channel is provided in the small diameter support part.

5. The die block device according to claim 2, wherein the block body holds the die including a small diameter part provided for extrusion and a large diameter part continuous with the small diameter part, the block body includes a small diameter support part that supports the small diameter part of the die, and a large diameter support part that supports the large diameter part of the die, and the gas channel is provided in the large diameter support part.

6. The die block device according to claim 2, wherein the block body has a temperature sensor incorporated therein, and when a detected temperature of the block body by the temperature sensor exceeds a previously set temperature, the cooling gas is supplied to the supply passage.

7. The die block device according to claim 1, wherein the support surface has an arcuate surface when viewed from front, and has the exhaust port of the gas channel, wherein an opening of the exhaust port is located within a range of ±30° from a height direction with reference to a center of curvature of the arcuate surface.

8. The die block device according to claim 1, wherein the block body holds the die including a small diameter part provided for extrusion and a large diameter part continuous with the small diameter part, the block body includes a small diameter support part that supports the small diameter part of the die, and a large diameter support part that supports the large diameter part of the die, and the gas channel is provided in the small diameter support part.

9. The die block device according to claim 1, wherein the block body holds the die including a small diameter part provided for extrusion and a large diameter part continuous with the small diameter part, the block body includes a small diameter support part that supports the small diameter part of the die, and a large diameter support part that supports the large diameter part of the die, and the gas channel is provided in the large diameter support part.

10. The die block device according to claim 1, wherein the supply passage of the gas supply portion is fixed, and the die block portion is configured to reciprocate relative to the gas supply portion.

* * * * *